US008342561B2

(12) United States Patent
Kavarsky, Jr.

(10) Patent No.: US 8,342,561 B2
(45) Date of Patent: Jan. 1, 2013

(54) GLIDING BOARD BINDING WITH MOVABLE MEDIAL OR LATERAL SIDE PORTION

(75) Inventor: Raymond Robert Kavarsky, Jr., Waterbury, VT (US)

(73) Assignee: The Burton Corporation, Burlington, VT (US)

( * ) Notice: Subject to any disclaimer, the term of this patent is extended or adjusted under 35 U.S.C. 154(b) by 30 days.

(21) Appl. No.: 12/948,303

(22) Filed: Nov. 17, 2010

(65) Prior Publication Data

US 2012/0119471 A1 May 17, 2012

(51) Int. Cl.
*A63C 9/02* (2006.01)

(52) U.S. Cl. ..... 280/617; 280/11.36

(58) Field of Classification Search ..... 280/11.36, 280/14.21, 14.22, 617, 618, 623, 624, 625, 280/626, 633, 634, 636; 441/68, 74
See application file for complete search history.

(56) References Cited

U.S. PATENT DOCUMENTS

| | | | | |
|---|---|---|---|---|
| 4,141,570 | A * | 2/1979 | Sudmeier | 280/607 |
| 4,871,336 | A * | 10/1989 | Scheurer | 441/70 |
| 4,973,073 | A * | 11/1990 | Raines et al. | 280/624 |
| 5,713,587 | A | 2/1998 | Morrow et al. | |
| 5,758,895 | A | 6/1998 | Bumgarner | |
| 5,813,689 | A | 9/1998 | Mansure | |
| 5,855,390 | A * | 1/1999 | Hassell | 280/607 |
| 5,967,531 | A * | 10/1999 | Saillet | 280/11.36 |
| 6,331,007 | B1 * | 12/2001 | Bryce | 280/11.3 |
| 6,588,773 | B1 * | 7/2003 | Van Riet et al. | 280/14.22 |
| 6,641,163 | B2 | 11/2003 | Joubert des Ouches | |
| 7,762,573 | B2 | 7/2010 | Zaloom et al. | |
| 2001/0015543 | A1 * | 8/2001 | Joubert Des Ouches | 280/624 |
| 2008/0030000 | A1 | 2/2008 | Zaloom et al. | |
| 2009/0212513 | A1 | 8/2009 | Weissenberger | |

FOREIGN PATENT DOCUMENTS

| | | | |
|---|---|---|---|
| DE | 4416024 | C1 | 10/1995 |
| WO | WO 98/39070 | A1 | 9/1998 |
| WO | WO 2004/073811 | A1 | 9/2004 |
| WO | WO 2007/085064 | A2 | 8/2007 |

OTHER PUBLICATIONS

Extended European Search Report and the Written Opinion of the European Searching Authority for European Application No. EP 11 18 9161, Dated Mar. 30, 2012.

* cited by examiner

*Primary Examiner* — Frank Vanaman
(74) *Attorney, Agent, or Firm* — Wolf, Greenfield & Sacks, P.C.

(57) ABSTRACT

A binding with a medial and/or lateral side portion attached to a binding base and that can pivot or otherwise move about an axis that is generally along a heel-to-toe direction of the binding base. The medial and/or lateral side portions can form part of the binding sidewall and permit a rider to more freely move her feet in medial and/or lateral directions. One or more foot straps may engage with the medial and/or lateral side portions to secure a foot to the binding.

46 Claims, 6 Drawing Sheets

GLIDING BOARD BINDING WITH MOVABLE MEDIAL OR LATERAL SIDE PORTION

BACKGROUND OF INVENTION

Bindings are widely used to secure a rider's foot to a gliding board, whether a snowboard, wakeboard, water ski, snow ski, and so on. One such type of binding includes a so-called "baseless" binding in which a rider's foot may be placed directly on the gliding board surface and be secured in place by a structure that partially surrounds the foot. For example, U.S. Pat. No. 6,641,163 discloses a baseless binding arrangement in which an interface element is positioned between the sole of the rider's boot and the top side of the gliding board.

SUMMARY OF INVENTION

Bindings like that shown in U.S. Pat. No. 6,641,163 typically have rigid sidewalls that extend upwardly along the medial and lateral sides of the binding. These sidewalls can perform various functions including keeping the rider's foot in a desired location on the binding, providing an anchoring point for one or more binding straps or other foot engagement feature, providing a stiffening element or other structural support for the binding, and others. However, rigid sidewalls can prevent a rider from rotating or otherwise moving her feet in a side-to-side direction, e.g., so as to roll the foot toward the medial or lateral side. This restriction can in some cases make the binding less comfortable to the rider and/or prevent the desired movement to perform some types of maneuvers.

Aspects of the invention provide a binding that has a portion at the medial or lateral side that can pivot or otherwise move about an axis that is generally oriented along a heel-to-toe direction of the binding base. The medial and/or lateral side portions can form part of the binding sidewall and permit a rider to more freely move her feet in medial and/or lateral directions. In some embodiments, the medial and/or lateral portion may be resiliently biased to return to an initial position. For example, medial and/or lateral portions may normally extend generally upwardly relative to the binding base, yet be movable about respective axes that extend in the heel-toe direction. However, when the medial and/or lateral portions are moved from the initial, upwardly extending position, the medial and/or lateral portions may be biased to return to the upwardly extending position. For example, if a rider rolls her foot in a lateral direction, causing the lateral portion to pivot outwardly, the lateral portion may be biased to return to the upright position when the force of the rider's foot is removed. This bias may provide support for the rider's foot, urging the foot back to a more upright position. As a result, the rider may experience more support from the binding in medial and/or lateral movement. The biasing force may be provided by a heel portion of a heel hoop, a highback, a part of the medial and/or lateral portions themselves, or other elements.

In other embodiments, medial and/or lateral movement of the medial or lateral portions may be restricted or limited as desired. For example, extreme medial or lateral movement of the medial or lateral portions may make the binding uncomfortable to the rider or provide a binding that is not supportive enough for the rider's foot. Thus, movement of the medial and/or lateral portions may be limited, e.g., by a stop or other feature that prevents the medial or lateral portions from rotating medially or laterally any more than about 30-45 degrees from a vertical position (or some other initial position). In some embodiments, a lock feature may be provided that allows a rider to either allow the medial or lateral portion to move medially or laterally relative to the base, or to prevent such movement. For example, some riders may desire a binding that is less flexible in the medial or lateral directions, and so may prevent medial or lateral movement. Other riders may desire a more flexible binding and permit such movement.

In one aspect of the invention, a binding for use with a gliding board includes a base constructed and arranged to be secured to a gliding board to secure a rider's foot to the gliding board. In the case of a snowboard binding, the base may be arranged like that in a tray-type binding having a rigid bottom plate that is positioned between the rider's foot and the gliding board (and which may also accommodate a hold down disk or other component used to secure the base to the gliding board), may be arranged like that in a "baseless" binding in which the rider's foot may directly contact the gliding board's top surface (or an optional footbed may be interposed between the rider's foot and the gliding board), or may be arranged like a step-in binding, which may take a variety of different forms. The base may include medial and lateral sides, a heel end, a toe end, a heel-toe direction that extends from the heel end to the toe end, and a bottom surface arranged to contact a top surface of a gliding board.

The binding may include a medial side portion that is attached to the medial side of the base and extends along at least a portion of the medial side in the heel-toe direction. The binding may also include a lateral side portion that is attached to the lateral side and extends along at least a portion of the lateral side of the base in the heel-toe direction. At least a part of the medial portion may be movable relative to the medial side about a medial axis that is generally along the heel-toe direction, and/or at least a part of the lateral portion may be movable relative to the lateral side about a lateral axis that is generally along the heel-toe direction. Although movable in medial and/or lateral directions, the medial and lateral portions may be fixed relative to the base in the heel-toe direction and in a direction away from the bottom surface of the base during use of the binding. That is, the medial and lateral portions may be relatively stationary in the heel-toe direction and a direction toward and away from the bottom surface of the base during use of the binding, but the medial and/or lateral portion may be adjustable relative to the base when the binding is not in use, e.g., removed from the base to adjust a position of the medial or lateral portion in the heel-toe or other direction relative to the base, to replace a component of the medial or lateral portion, to perform a repair of the binding, etc. For example, the medial portion may be pivotable about an axis in the heel-toe direction so that the medial portion can rotate outwardly and inwardly relative to the base, but the medial portion may not move forward/back or up/down relative to the base during use of the binding.

The binding may also include at least one foot engagement member secured to the base and constructed and arranged to secure the rider's foot relative to the base. For example, the binding may include one or more foot straps that include two portions (such as an engagement portion engageable with, and selectively separable from, a buckle portion) that can be extended over a rider's foot, and secured together so as to secure the rider's foot to the binding and gliding board. The engagement member may, or may not, be attached directly to the base, or may be attached to the medial and/or lateral portion (which is in turn attached to the base). Other foot engagement arrangements are possible, such as clasps, latches and other arrangements used with step-in bindings and others.

By having medial and/or lateral portions of the binding arranged for movement about axes arranged generally in the heel-toe direction, the binding may be made not only more comfortable for the rider during particular maneuvers, but certain maneuvers may be made possible that simply cannot be performed with other bindings. Further, in some embodiments, the binding may not only permit foot movement that was previously impossible, but also provide resilient support for the foot in such movement.

In one embodiment, the medial and lateral side portions attached to a heel hoop such that the medial and lateral portions are connected together by a heel portion of the heel hoop that extends across the heel end of the base. By having the heel portion connect the medial and lateral portions together, the medial and lateral portions may move together (if both portions are permitted to move relative to the base), e.g., so as to maintain close engagement with the rider's foot. Also, the heel portion may be arranged to provide a bias to the medial and lateral portions, e.g., to urge the portions to return to an upright position. In some embodiments, the medial and lateral portions may be pivotally attached to the base at the heel end of the medial and lateral sides, as well as fixedly attached to the base at the toe end of the medial and lateral sides. By fixing the medial and/or lateral portions at the toe end while providing a pivotal connection at the heel end, the medial and/or lateral portions may themselves provide a bias to the portions, e.g., to restore the portions to an initial position. For example, a mid-region of the medial and lateral portions may act like a torsion bar or similar element that biases the part of the heel end of the medial and lateral portions to return to an upright position.

In another aspect of the invention, a binding for use with a gliding board may include a heel hoop with medial and lateral portions that are attached to the base so that at least a part of the medial or lateral portions are pivotable relative to the medial or lateral sides of the base about a medial or lateral axis, respectively. The medial and lateral portions of the heel hoop may extend from the heel end to the toe end of the base, and may provide rider foot movement in medial and lateral directions. The binding base may be constructed and arranged to secure a rider's foot to the gliding board, and may include a heel end, a toe end, a heel-toe direction that extends from the heel end to the toe end, and a bottom surface arranged to contact a top surface of a gliding board. The heel hoop may include a heel portion that extends across the heel end of the base and connects the medial and lateral portions together. At least one foot engagement member may be secured to the base and constructed and arranged to secure the rider's foot relative to the base, e.g., a pair of foot straps including an ankle or instep strap and a toe strap may be arranged to extend over a rider's foot and secure the foot in place relative to the binding.

In some embodiments, the binding may include a highback or other leg support secured to the base and constructed and arranged to support a rider's leg. As is known in the art, the highback may be arranged to contact the rider's calf region to help the rider influence the movement of the gliding board. The highback may be attached to the medial and lateral portions, and thus the highback may move when the medial and/or lateral portions move about the medial or lateral axis, respectively.

In another aspect of the invention, a binding for use with a gliding board may include a highback that is secured to a binding base and is constructed and arranged to support a rider's leg. The highback may have an upper portion arranged to contact the rider's leg, and a lower portion that is attached to the medial and lateral sides of the base such that lower portion is pivotable relative to the medial or lateral sides about a medial or lateral axis, respectively. Thus, in some embodiments, at least a part of a highback may be attached to a binding base for movement about a medial and/or lateral axis. For example, the binding base may be constructed and arranged to secure a rider's foot to the gliding board, and may include medial and lateral sides, a heel end, a toe end, a heel-toe direction that extends from the heel end to the toe end, and a bottom surface arranged to contact a top surface of a gliding board. Medial and lateral parts of the highback's lower portion may be pivotally attached to the base at medial and lateral sides of the base such that the medial and lateral parts can pivot about medial and lateral axes. At least one foot engagement member may be secured to the base and constructed and arranged to secure the rider's foot relative to the base, e.g., a pair of foot straps including an ankle or instep strap and a toe strap may be arranged to extend over a rider's foot and secure the foot in place relative to the binding. Such an arrangement may permit the highback to move medially and/or laterally with the rider's leg in some situations, allowing the highback to move and maintain contact with the rider's leg.

These and other aspects of the invention will be appreciated from the following description and claims.

BRIEF DESCRIPTION OF THE DRAWINGS

Aspects of the invention are described below with reference to the following drawings in which like numerals reference like elements, and wherein.

DETAILED DESCRIPTION

Figure 1:
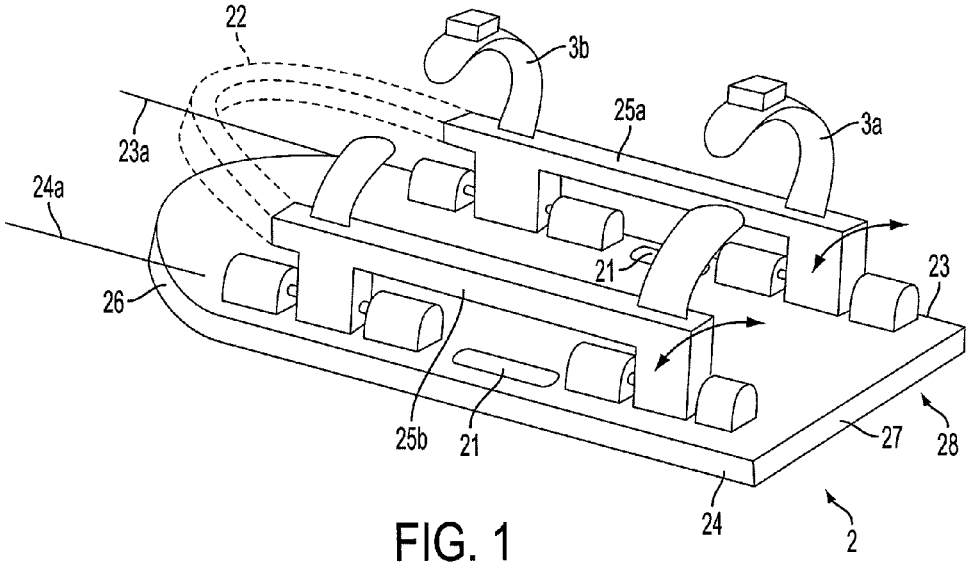
FIG. 1 shows a perspective view of an illustrative binding in accordance with the invention.

It should be understood that aspects of the invention are described herein with reference to the figures, which show illustrative embodiments in accordance with aspects of the invention. The illustrative embodiments described herein are not necessarily intended to show all aspects of the invention, but rather are used to describe a few illustrative embodiments. For example, although aspects of the invention are described below with reference to a snowboard binding used in conjunction with a snowboard, aspects of the invention may be used with any suitable gliding board and corresponding binding. Thus, aspects of the invention are not intended to be construed narrowly in view of the illustrative embodiments. In addition, it should be understood that aspects of the invention may be used alone or in any suitable combination with other aspects of the invention.

As discussed above, one aspect of the invention relates to providing a medial or lateral portion of the binding, e.g., a part of a binding sidewall structure that flanks a side of the rider's foot, arranged for movement about an axis that is generally aligned with the heel-toe direction of the binding. The medial and/or lateral portions may be arranged in a variety of different ways, e.g., may be part of a heel hoop structure, may be part of a highback structure, and/or may be independent of any heel hoop or highback or other part of the binding. The medial and/or lateral portions may, or may not, serve as a connection point for a binding strap or other foot engagement member of the binding. For example, a two-part binding strap may have one part attached to a medial or lateral portion and arranged so that as the rider moves his foot medially or laterally, the medial and/or lateral portion as well as the attached strap part move with the rider's foot. This type of arrangement may permit a desired medial and lateral range of motion for the foot while also providing a secure engagement of the foot to the gliding board. In some embodiments, the medial and lateral portions may be moved away from a foot receiving area of the base, allowing a rider easier access for placing his foot in the binding. Thereafter, the medial and lateral portions may be moved to at least partially surround the rider's foot when the foot is secured to the binding.

In some embodiments, the medial and/or lateral portions may be resiliently biased to move toward an initial position, e.g., an upright position that corresponds to a rider standing at ease on the gliding board or otherwise places little or no force on the medial and/or lateral portions. In this way, the rider's foot may be held in the binding without the medial and/or lateral portions "clamping" the foot or otherwise exerting force on the foot when the rider is at rest. However, when the rider moves the medial and/or lateral portions, e.g., when forcing the foot to roll toward a lateral side, the medial and/or lateral portions may give way, yet exert a force on the rider's foot that tends to move the foot back toward the initial position. In another embodiment, the medial and/or lateral portions may be arranged to apply a force to the rider's foot at all times. For example, the medial and lateral portions may be arranged to normally fold inwardly toward the foot receiving area of the base under a spring force. To place a foot in the binding, the rider may be required to spread the medial and lateral portions apart to expose the foot receiving area of the binding. After placement of the foot in the binding and the medial and lateral portions are released, the medial and lateral portions may exert a force on the medial and lateral sides of the rider's foot, e.g., squeezing the foot in the binding from opposite sides. In some embodiments, the medial and/or lateral portions may engage the foot, e.g., by having complementary locking members of the boot and medial/lateral portions engage with each other so as to help keep the foot secured within the binding.

FIG. 1 shows a perspective view of a snowboard binding 1 that incorporates various aspects of the invention. This illustrative embodiment includes a base 2 with a medial side 23 opposite a lateral side 24, and a heel end 26 opposite a toe end 27. (The medial side 23 is that side of the rider's foot at the inside of the foot, e.g., the side on which the arch and ball of the foot are located. The lateral side 24 is the outer part of the rider's foot. Similarly, the heel end 26 is where the rider's heel is positioned, and the toe end 27 is where the rider's toe is positioned. Accordingly, a heel-toe direction is a direction that extends from the heel end 26 to the toe end 27 of the base 2.) The base 2 also has a bottom surface 28 that is arranged to contact a gliding board or other surface to which the binding 1 is mounted, and a pair of foot engagement members 3 (e.g., foot straps) to secure a rider's foot to the binding 1. The base 2 may include any suitable features for securing the binding 1 to a gliding board. For example, the base may include a pair of openings 21 at the medial and lateral sides 23, 24 to receive a screw or other fastener for securing the base 2 relative to a gliding board, such as a snowboard. The openings 21 may be formed integrally with other portions of the base 2, and may have a metal insert or other reinforcement to support a fastener engaged at the opening 21. For example, in one embodiment, the openings 21 may have a slot shape and may include a metal washer that surrounds each slot. In this illustrative embodiment, the base 2 may be secured to a snowboard using a threaded fastener, such as a screw, bolt or nut, although other arrangements may be used. In other embodiments, the base 2 may be secured to a board using a hold down disk, or any other suitable arrangement. For example, the base 2 may include an opening 21 that is arranged as a hole near a center of the base 2 that receives a hold down disk, which is secured to the gliding board. Such arrangements are well known in the art. If a hold down disk is used, the base 2 and accompanying disk may be arranged to cooperate with any suitable fastening arrangement, e.g., a 4×4, 3D(R) or other threaded insert pattern used in snowboards. The illustrative embodiment of FIG. 1 is arranged to operate with a channel-type slot in a board, such as that described in U.S. Pat. No. 7,762,573.

In accordance with an aspect of the invention, the binding 1 includes a medial and/or a lateral side portion 25 that is attached at a medial side 23 or lateral side 24, respectively, of the base 2. The medial and/or lateral portion 25 may be arranged so as to be movable about an axis that is generally aligned with a heel-toe direction of the base 2. For example, the medial portion 25*a* may be pivoted relative to the base 2 about a medial axis 23*a*, and the lateral portion 25*b* may be pivoted relative to the base 2 about a lateral axis 24*a*. The medial and/or lateral portions 25 may be attached to the base 2 in any suitable way so as to provide the desired movement of the portions 25 relative to the base 2. In this illustrative embodiment, the medial and lateral portions 25 extend from the heel end 26 to the toe end 27 of the base, and are mounted by pivot pins to upwardly extending elements (e.g., hinge knuckles) of the base 2. However, other arrangements are possible. For example, the medial and lateral portions 25 may attached to the base 2 by one or more other types of hinges, by a living hinge structure, a flexible webbing, an articulable joint (such as a ball and socket joint), and others. Also, although in this embodiment the medial and lateral portions 25 may rotate freely about the medial and lateral axes 23*a*, 24*a* both toward and away from the foot receiving area of the base 2 between the medial and lateral sides 23, 24, the medial and lateral portions 25 may be more restricted in movement. For example, one or both of the medial and lateral portions 25 may be permitted to move only toward the foot receiving area, or only away from the foot receiving area, from the upright position shown in FIG. 1. In some embodiments, the medial and lateral portions 25 may be arranged for rotation about the medial and lateral axes 23*a*, 24*a* of about 30 to 45 degrees in either direction (medially and laterally) from an upright position like that shown in FIG. 1.

Movement of the medial and/or lateral portions 25 may be restricted or otherwise limited as desired. For example, the medial and lateral portions 25 may be permitted to freely move outwardly from a foot receiving area, but may be prevented from moving inwardly toward the foot receiving area, e.g., by stops or other structures that prevent such movement. In another embodiment, the medial and lateral portions 25 may be limited to rotating, for example, no more than 30 degrees from an upright position. Again, this limitation on motion may be provided by one or more stops, walls, tabs or other structures that physically interfere with the motion of the medial and lateral portions 25. In yet another embodiment, movement of the medial and/or lateral portions 25 may be selectively locked/unlocked such that a rider can choose whether the medial and/or lateral portions 25 are permitted to move about the axes 23*a*, 24*a* or not. For example, each medial and lateral portion 25 may be provided with a latch (e.g., similar to a bolt-type latch commonly used on doors) that can be selectively operated to either fix the medial and lateral portions 25 relative to the base 2, or permit their movement. In some embodiments, damping of the movement of the medial and lateral portions 25 may be provided, e.g., by a friction element between the base 2 and the medial and lateral portions 25. Damping may not necessarily limit an extent to which the medial and lateral portions 25 can move, or exert a biasing force on the medial and lateral portions 25, but rather limit the speed at which the medial and lateral portions 25 may move for a given force. For example, a rubber washer may be positioned between a hinge knuckle on the medial and/or lateral portions 25 and a hinge knuckle on the base 2 and arranged to damp the movement of the medial and lateral portions 25.

In addition, the medial and lateral portions 25 may be resiliently biased to return to an initial position when moved away from the initial position. For example, the medial and lateral portions 25 may be arranged so that, when moved from the upright position shown in FIG. 1, the medial and lateral portions 25 are biased to return to the upright position. This biasing feature may be provided in a variety of different ways, such as by one or more springs, a rubber or other resilient material, and other arrangements. For example, a coil spring may be arranged at the pivot pin mount of the medial and lateral portions 25 so as to provide a biasing force that urges the medial and lateral portions 25 to remain in the upright position. In other arrangements, the medial and lateral portions 25 may be configured to be biased to other positions, such as a position in which the medial and lateral portions 25 are folded inwardly toward the foot receiving area, or outwardly away from the foot receiving area. Biasing the medial and lateral portions 25 inwardly may help squeeze a rider's foot that is mounted in the binding, potentially aiding in keeping the foot in the binding and/or helping a rider engage foot straps or other foot engagement members. For example, the rider's boot may have bosses, tabs or other locking members that are complementary to grooves, slots or other locking members that are part of the medial and/or lateral portions 25. In one embodiment, a rider's boot may include one or more bosses that fit within an opening in a part of the medial or lateral portion 25 between the heel and toe ends of the binding. The bosses and openings (complementary locking members) may engage with each other so as to hold the rider's foot in place relative to the binding 1, while the clamping force provided by the medial and lateral portions 25 helps to keep the bosses and openings in engagement with each other. This engagement may help keep the foot in place while the rider secure foot straps.

In another embodiment in which the medial and/or lateral portions 25 are biased to move away from a foot receiving area, folding open of the medial and/or lateral portions 25 may make it easier for a rider to place his foot in the binding 1. After placing the foot, the rider may pull the medial and/or lateral portions 25 toward the boot and engage foot straps or otherwise secure the foot in the binding 1. Moving the medial and/or lateral portions 25 toward the foot may also engage complementary locking members of the medial and/or lateral portions 25 and the boot, as discussed above.

In another illustrative embodiment, the medial and lateral portions 25 may be attached to a heel hoop 22 that includes a heel portion (shown in dashed line in FIG. 1) that extends across the heel end 26 of the base 2 and connects the medial and lateral portions 25 to each other. The heel portion of the heel hoop 22 may provide a resilient biasing of the medial and lateral portions 25 as discussed above, e.g., to provide a bias that tends to move the medial and lateral portions 25 toward the upright position shown in FIG. 1. That is, the heel portion may be suitably stiff, yet flexible, to allow for desired movement of the medial and lateral portions 25 about their respective axes 23*a* and 24*a*, but provide a restoring force that tends to return the medial and lateral portions 25 to their upright position (or some other position). The heel hoop 22 may also provide other known support functions, such as supporting a rider's heel area during riding, providing support for a highback or other leg support (not shown, and if provided), providing a reference structure from which a forward lean for a highback or other component may be defined, and so on. The heel hoop 22, including the medial and lateral portions 25 and the heel portion, may be molded as a single unitary piece (e.g., using a fiber-reinforced plastic), or the medial and lateral portions 25 and the heel portion may be made separately and then attached together (e.g., by screws or other threaded fasteners, rivets, adhesive, welding, etc.).

In this illustrative embodiment of FIG. 1, the foot engagement members 3 are attached to the base 2 via the medial and lateral portions 25. That is, in this embodiment a toe strap 3*a* and an ankle strap 3*b* are attached to the medial and lateral portions 25 and are arranged to extend over the rider's foot and secure the foot to the binding. By attaching the straps 3 to the medial and lateral portions 25, the straps 3 may move with the medial and lateral portions 25, potentially allowing for a wider range of movement than if the straps 3 were attached directly to the base 2. However, it should be understood that one or more of the straps 3 may be attached directly to the base 2, e.g., the toe strap 3*a* parts may be directly attached to the toe end 27 of the base 2. Moreover, it should be understood that any suitable type of foot engagement member(s) 3 may be used to secure a rider's foot relative to the base 2, such as any suitable number or type of foot straps that use typical ratchet buckles to engage two strap members together, boot engagement members used to secure a boot in step-in type bindings, or any other arrangement or combination of arrangements.

In some embodiments, the medial and lateral portions 25 may be made to be adjustable in position on the base 2, e.g., to allow for heel-toe adjustment in position of the medial and lateral portions 25 on the base, to allow for up-down adjustment of the height of the medial and lateral portions 25, and other position changes. However, if the medial and lateral portions 25 are made adjustable, such adjustment may be intended to be performed when the binding is not in use (i.e., not during riding), but rather while the rider has stopped on a slope or while the binding 1 is on a workbench. Otherwise, while the binding 1 is in use, the medial and lateral portions 25 may be made fixed relative to the base in the heel-toe direction and up-down direction relative to the bottom surface 28. Also, the medial and lateral portions 25 need not be pivotally or otherwise movably attached to the base 2 at two positions, but rather may be pivotally attached to the base 2 at only one location (e.g., at the heel end 26) while being fixed in place at another location (e.g., at the toe end 27). In such a case, the medial and lateral portions 25 may themselves provide a biasing feature that tends to return the medial and lateral portions 25 to an initial position if moved from the initial position.

Figure 2:
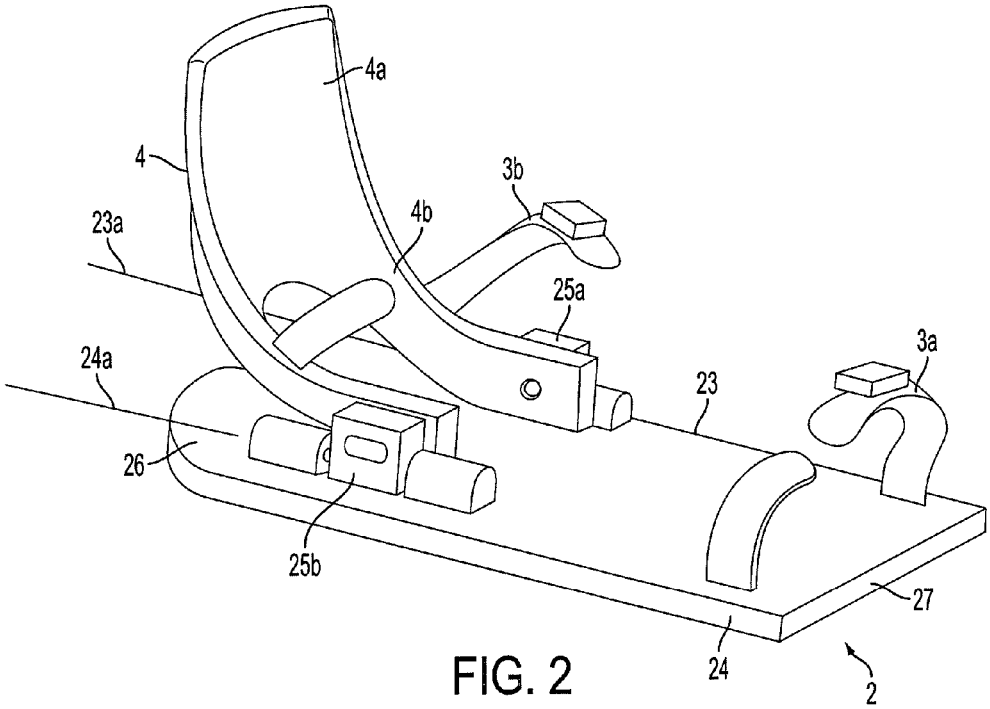
FIG. 2 shows a perspective view of another illustrative binding in accordance with the invention.

In another illustrative embodiment, the medial and lateral portions may be integrated with a highback or other leg support of a binding. Such an arrangement may allow for the highback to move laterally/medially with the rider's leg while maintaining contact with the leg. Thus, the rider may experience a binding that provides a more supple, flexible response in lateral/medial directions while also finding the binding very responsive to input in the heel-toe direction. FIG. 2 shows an illustrative embodiment in which a binding 1 has medial and lateral portions 25 integrated with a highback 4. In this embodiment, the highback 4 includes an upper portion 4*a* arranged to contact a rider's leg (e.g., the rider's calf area) and a lower portion 4*b* that is attached to medial and lateral portions 25, which are attached to the medial and lateral sides 23, 24 of the base 2. Similar to the embodiment in FIG. 1, the medial and lateral portions 25 are pivotally attached to the base 2, e.g., by pivot pins, so that the medial and lateral portions 25 are movable about medial and lateral axes 23*a*, 24*a* relative to the base 2. Of course, the medial and lateral portions 25 may be attached to the base 2 in other ways, as discussed above. Also, in this embodiment, the medial and lateral portions 25 are only located at the heel end 26 of the base 2, but may extend toward, or to, the toe end 27, if desired.

Another feature of this embodiment is that the medial and lateral portions 25 are resiliently biased to return to an initial position, e.g., a position in which the highback 4 is oriented in a vertical or other suitable direction. For example, when no force is applied to the highback 4, the highback 4 may be oriented in a vertical position like that shown in FIG. 2. If the highback 4 is moved laterally or medially, such as by a rider's leg, the lower portion 4*b* of the highback 4 may deform as the medial and lateral portions 25 move about their respective axes 23*a*, 24*a*. Deformation of the highback 4 may be elastic so that when the force moving the highback 4 laterally or medially is released, the highback 4 may return to the vertical position. Thus, the biasing feature that urges the highback 4 to return to an initial position may be provided by the shape and material of the highback (particularly of the lower portion 4*b*) as well as the structure of the base 2 (which may be rigid and remain unchanged in shape as the highback 4 moves). In other embodiments, springs, resilient materials, or other arrangements may provide a biasing force that is applied to the medial and lateral portions 25 and/or the highback's upper portions 4*a*.

In this illustrative embodiment, the highback 4 is secured to the medial and lateral portions 25 (e.g., by bolts) at slots formed in the medial and lateral portions 25. Although the highback 4 may be mounted to the medial and lateral portions 25 using simple holes, the slots may allow the highback 4 to be rotated and fixed in place relative to the base 2 within a range of angles about an axis that extends generally along the length of a rider's lower leg. In another embodiment, the location where the medial and lateral portions 25 are attached to the base 2 may be adjusted in the heel-toe direction, e.g., by making the hinge knuckles that are fixed to the base 2 movable in the heel-toe direction relative to the base 2. Although the attachment locations may be changed, the attachment locations are intended to remain fixed during use of the binding 1. Various features of the highback 4 may be arranged in any suitable way, e.g., the highback 4 may have any suitable height, width, curvature, stiffness, or other size or shape, may have a forward lean adjuster or not, and so on. Although in this embodiment the binding 1 includes a toe strap 3*a* attached to the base 2 near a toe end 27, and an ankle strap 3*b* attached to the highback 4, other arrangements are possible, as discussed above. For example, the foot engagement members 3 may include a step-in binding type device that is mounted to the base 2 and engages directly with a boot to secure the boot to the binding 1.

Figure 3:
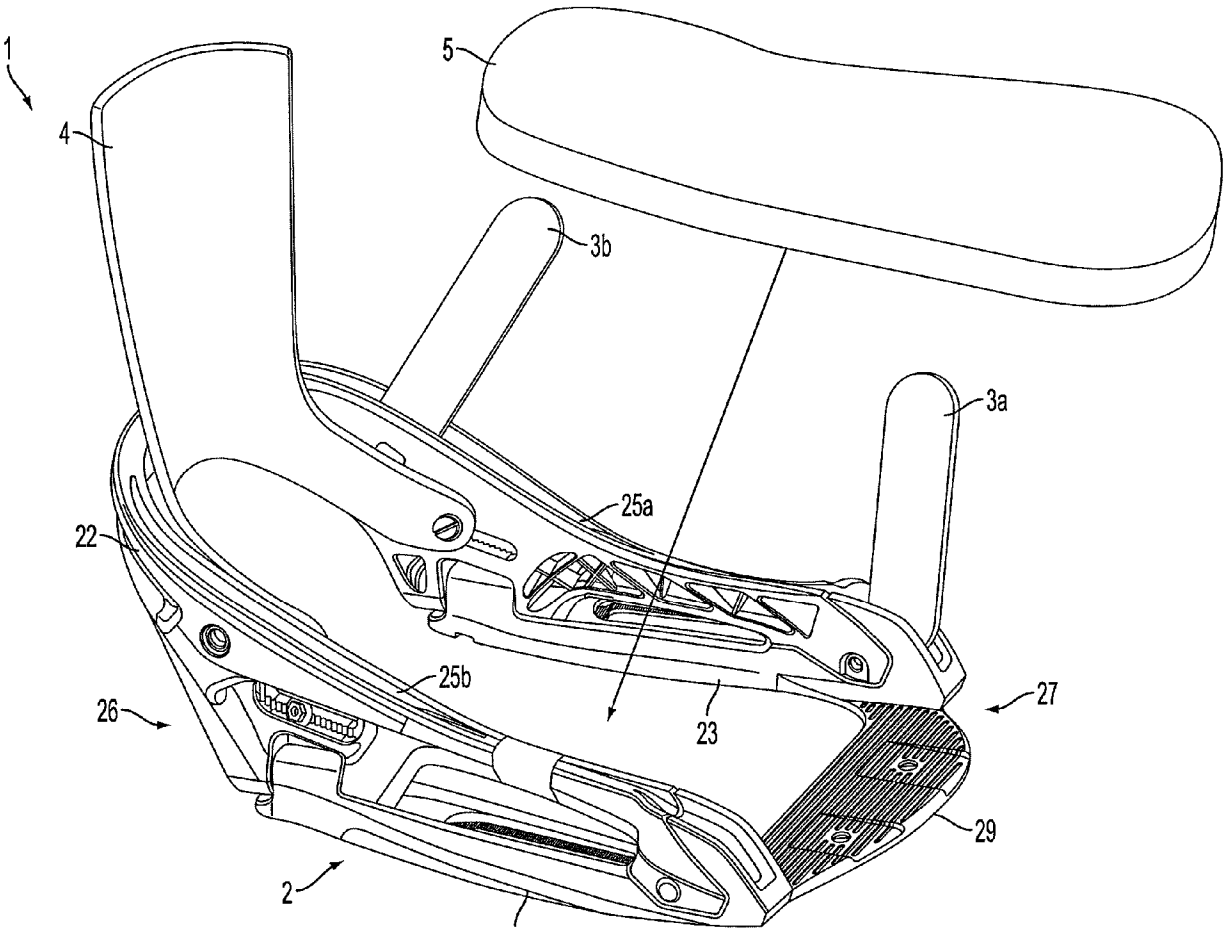
FIG. 3 shows a front, right perspective view of yet another illustrative binding in accordance with the invention.

FIG. 3 shows a front, right side perspective view of yet another illustrative binding that incorporates one or more aspects of the invention. In this illustrative embodiment, the binding 1 includes a base 2 with medial and lateral sides 23, 24. Unlike the embodiment of FIG. 1, the base 2 in FIG. 3 includes an opening between the medial and lateral sides 23, 24 that receives a rider's foot and allows the foot to directly contact a gliding board (or other surface) to which the binding 1 is mounted. That is, the binding 1 in FIG. 1 has a so-called "baseless binding" arrangement. Although not required, the medial and lateral sides 23, 24 are connected together at a toe end 27 by a crossbar 29. In this embodiment, the crossbar 29 is arranged to be a generally flat strip that spans across the opening between the medial and lateral sides 23, 24 and has a bottom surface that contacts the gliding board when the binding 1 is mounted to the board. The crossbar 29 in this embodiment also has a pair of holes that may be used to engage with a footbed 5 that can optionally be placed in the opening between the medial and lateral sides 23, 24 and interposed between the rider's foot and the gliding board. That is, a pair of screws or other fasteners may pass through the holes in the crossbar 29 and used to secure the footbed 5 in place relative to the base 2.

The footbed 5 may have a variety of different features, including adjustable toe and heel portions, a binding position indicator, and others described in U.S. Pat. No. 7,762,573, which is hereby incorporated by reference in its entirety. For example, the footbed 5 may have a toe portion that is attached and moveable in a heel-to-toe direction relative to a heel portion of the footbed 5, e.g., to accommodate different sized feet and/or boot shapes. Moreover, the footbed 5 may include more than two portions, such as a central portion, a heel portion and a toe portion, with the heel and toe portions being movable relative to the central portion. The footbed 5 may engage with the base 2 in other ways than by connection to the crossbar 29, e.g., by way of right angle tabs or lugs which slide into slots formed in the medial and lateral sides 23, 24. Other arrangements are possible for engaging the footbed 5 with the base, including tabs that extend laterally from the sides of the footbed 5 and that engage with lateral slots formed in the medial and lateral sides 23, 24. Such an arrangement may allow the footbed 5 to be removed from the binding 1 without removing the base 2 from a board. Other arrangements will occur to those of skill in the art, such as screws, adhesive or other fastener engagements between the footbed 5 and the base 2, the footbed 5 may have wings or a flange that is trapped between the base 2 and the board when the binding 1 is mounted, the footbed 5 may include laterally extending portions that slide into grooves in the medial and lateral sides 23, 24 that extend in the heel-to-toe direction, and others. It is also possible for the footbed 5 to be secured directly to the board, and not necessarily be secured to the base 2. In another embodiment, the footbed 5 may include one or more adjustment indicators to provide one or more binding position indications. The adjustment indicator(s) may allow a rider to determine the position of the binding 1 relative to the board, specifically a longitudinal position of the binding 1 in a tip-to-tail direction on the board, a heel-to-toe position of the binding 1, and/or an angular position (e.g., a rotational position of the binding about a vertical axis that is generally perpendicular to the top surface of the board).

In accordance with an aspect of the invention, the heel hoop 22 includes medial and lateral portions 25 that are pivotally attached to the heel end 26 of the base 2. (Of course, it is possible that only one of the medial and lateral portions 25 is pivotally attached to the base 2 (e.g., the medial portion 25*a*), while the other is fixed to the heel end 26 (e.g., the lateral portion 25*b*).) The medial and lateral portions 25 also extend from the heel end 26 to the toe end 27 of the base 2, where the medial and lateral portions 25 are fixed to the base 2. The binding 1 also includes a pair of foot engagement members 3. A toe strap 3*a* has two portions (only a medial portion is shown in FIG. 3) that are directly attached to the base (e.g., by engaging with a slot formed in the base 2 at the toe end 27). An ankle strap 3*b* has two portions (only a medial portion is shown in FIG. 3) that are directly attached to the medial and lateral portions 25 (e.g., by being inserted into a vertical slot and secured to the portions 25 by a bolt and nut). As is known in the art, the two portions of the toe and ankle straps 3*a*, 3*b* can be extended over the rider's foot and joined together to secure the foot to the binding. Of course, other foot engagement member arrangements are possible. The binding 1 in this embodiment also includes a highback 4 that is attached to the medial and lateral portions 25, e.g., by a nut and bolt attachment to a slot formed in the medial and lateral portions 25 that allows the highback 4 to be rotated relative to the base 2 about a generally vertical axis. In other embodiments, the highback 4 may be directly attached to the base 2.

Figure 4:
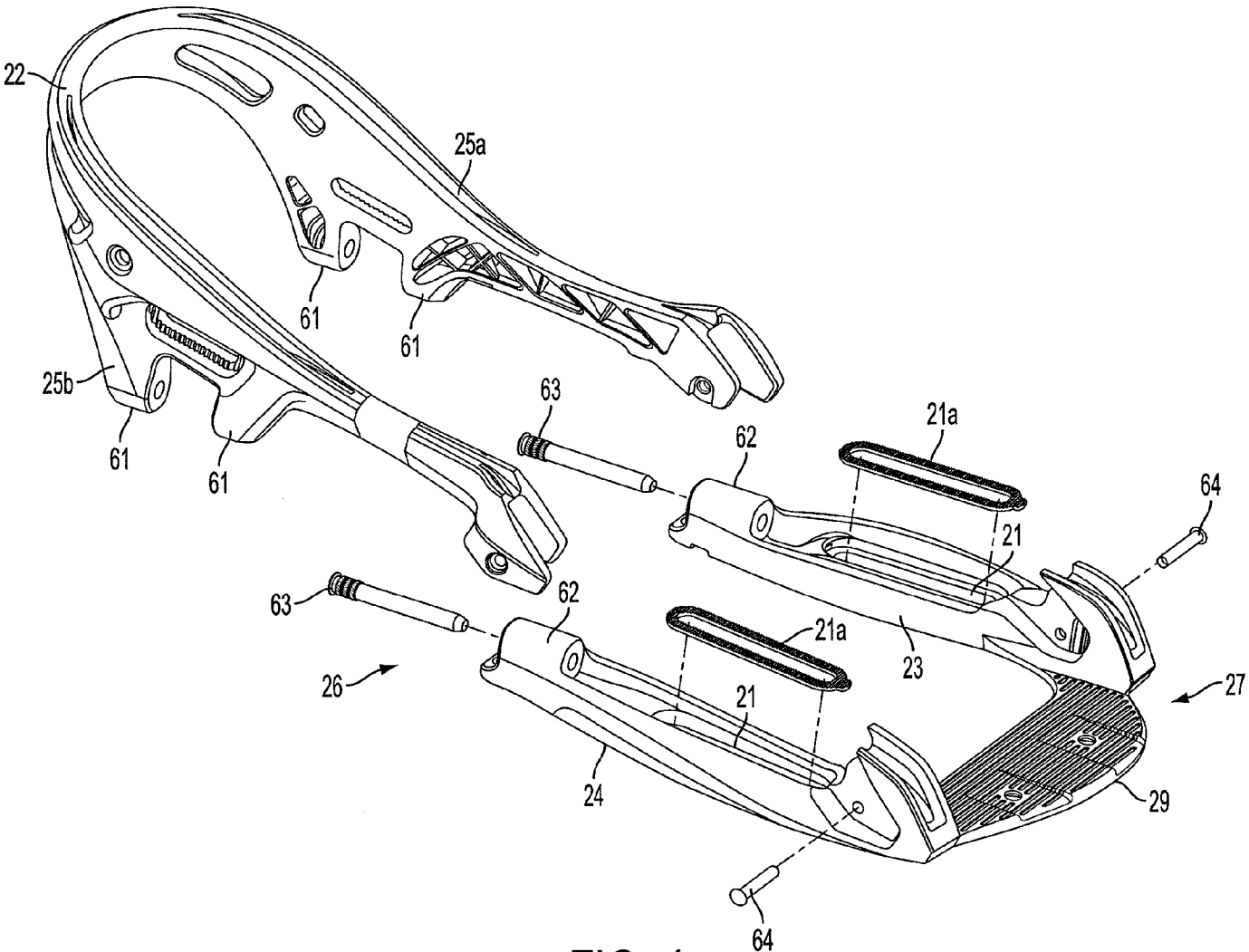
FIG. 4 shows an exploded view of the binding of FIG. 3.

FIG. 4 shows an exploded view of the binding 1 of FIG. 3 without the highback 4 for clarity. The part of the medial and lateral portions 25 near the heel end 26 is formed to include a pair of hinge knuckles 61 arranged to receive a hinge knuckle 62 that extends upwardly from the medial and lateral sides 23, 24 of the base 2. A hinge pin 63 is inserted through the aligned holes in the knuckles 61, 62, completing the pivotal connection of the medial and lateral portions 25 with the base 2. As mentioned above, other arrangements may be used to establish a pivotal or other connection that allows for movement of the medial and lateral portions 25 relative to the base 2, such as flexible webbing, ball and socket joints, a living hinge structure, engaged chain links, and others. Also, multiple hinge knuckles could be used, e.g., three or more on the base 2 and two or more on the medial and lateral portions 25.

The medial and lateral portions 25 extend forward of the pivotal connection to the base 2 to a toe end 27 where the medial and lateral portions 25 are fixed to the base 2. In this embodiment, the forward ends of the medial and lateral portions 25 have a forked section that receives a part of the base 2. Pins 64 secure the forward ends of the medial and lateral portions 25 to the base 2 so that the forward ends of the medial and lateral portions 25 are fixed in place relative to the base 2. This arrangement of attaching the medial and lateral portions 25 to the base 2 may permit the medial and lateral portions 25 to be selectively removed from the base 2, e.g., by removing the pins 63 and 64, to allow an exchange of the heel hoop 22 and medial and lateral portions 25, to reduce the height of the board/binding combination for storage or shipping, to make a repair, etc. Again, other arrangements for attaching the medial and lateral portions 25 to the base 2 at the toe end 27 are possible, including adhesives, a unitary molded structure, screws or other fasteners, welding, and so on. For example, the base 2 and the medial and lateral portions 25 could be molded as a single unitary part with the hinge knuckles 61, 62 disengaged in the molded part. After molding is complete, the knuckles 61, 62 may be brought together and the pins 63 set to provide the pivotal connection.

Although the medial and lateral portions 25 are fixed to the base 2 at the toe end 27, a central part, or mid-region, of the medial and lateral portions 25 between the pivotal connection at the heel end 26 and the fixed attachment at the toe end 27 may be flexible so as to allow the part of the medial and lateral portions 25 near the heel end 26 to move independently of the part of the medial and lateral portions 25 near the toe end 27. For example, a part of the medial and lateral portions 25 at the heel end 26 may be permitted to rotate 30 to 45 degrees or more, both laterally and medially, from an upright position. In some embodiments, since the toe end of the medial and lateral portions 25 may be fixed to the base 2, the mid-region of the medial and lateral portions 25 may provide a biasing force that helps the medial and lateral portions 25 to return to an initial position after having been moved (e.g., by a rider's foot) laterally or medially. While the mid-region of the medial and lateral portions 25 may provide some restriction on the movement of the medial and lateral portions 25 about the axes 23*a*, 24*a*, other components may be used to establish limits to their movement. For example, one or more stops, walls, tabs, pins, etc., may be arranged to limit movement of the medial and lateral portions 25 about the axes 23*a*, 24*a* to any desired extent. For example, the medial and lateral portions 25 may be permitted to move more in a medial direction than in a lateral direction, or vice versa. In other embodiments, movement in the medial or lateral direction may be entirely prevented for one or both of the medial and lateral portions 25. Such locking features may be made selectively engageable so that the rider can choose whether to allow movement of the medial and/or lateral portions 25 or not, and if to allow movement, an extent to which the movement is permitted. For example, a latch or locking bolt that fixes the hinge knuckles 61, 62 relative to each other may be provided that selectively locks the medial and/or lateral portions 25 to the base 2 so that medial or lateral movement is prevented. Other arrangements will occur to those of skill in the art.

The heel portion of the heel hoop 22 may also influence the way in which the medial and lateral portions 25 move, as discussed above. For example, the heel portion may be made to be relatively flexible, relatively rigid, etc., to provide the desired movement characteristics of the medial and lateral portions 25. In some embodiments, the heel portion may include a hinge, a flexible connecting member (such as resilient rubber), a four bar linkage or other component that attaches the medial and lateral portions 25 to each other. Thus, the heel portion, together with the mid-region of the medial and lateral portions 25, may help define how the medial and lateral portions 25 move relative to the axes 23*a*, 24*a*.

In this embodiment, the medial and lateral sides 23, 24 of the base 2 include openings 21 in the form of slots that are arranged to receive one or more fasteners to secure the binding 1 to a gliding board. Washers 21*a* may optionally be included, e.g., to help distribute the force of the fasteners across a larger surface area of the base 2 near the openings. Although in this embodiment the medial and lateral sides 23, 24 have upwardly extending portions that form a part of the sidewall of the base 2, the medial and lateral sides 23, 24 may be arranged to be generally flat and to have a lower profile. Thus, the medial and lateral portions 25 may form all or part of a sidewall of the base 2.

Figure 5:
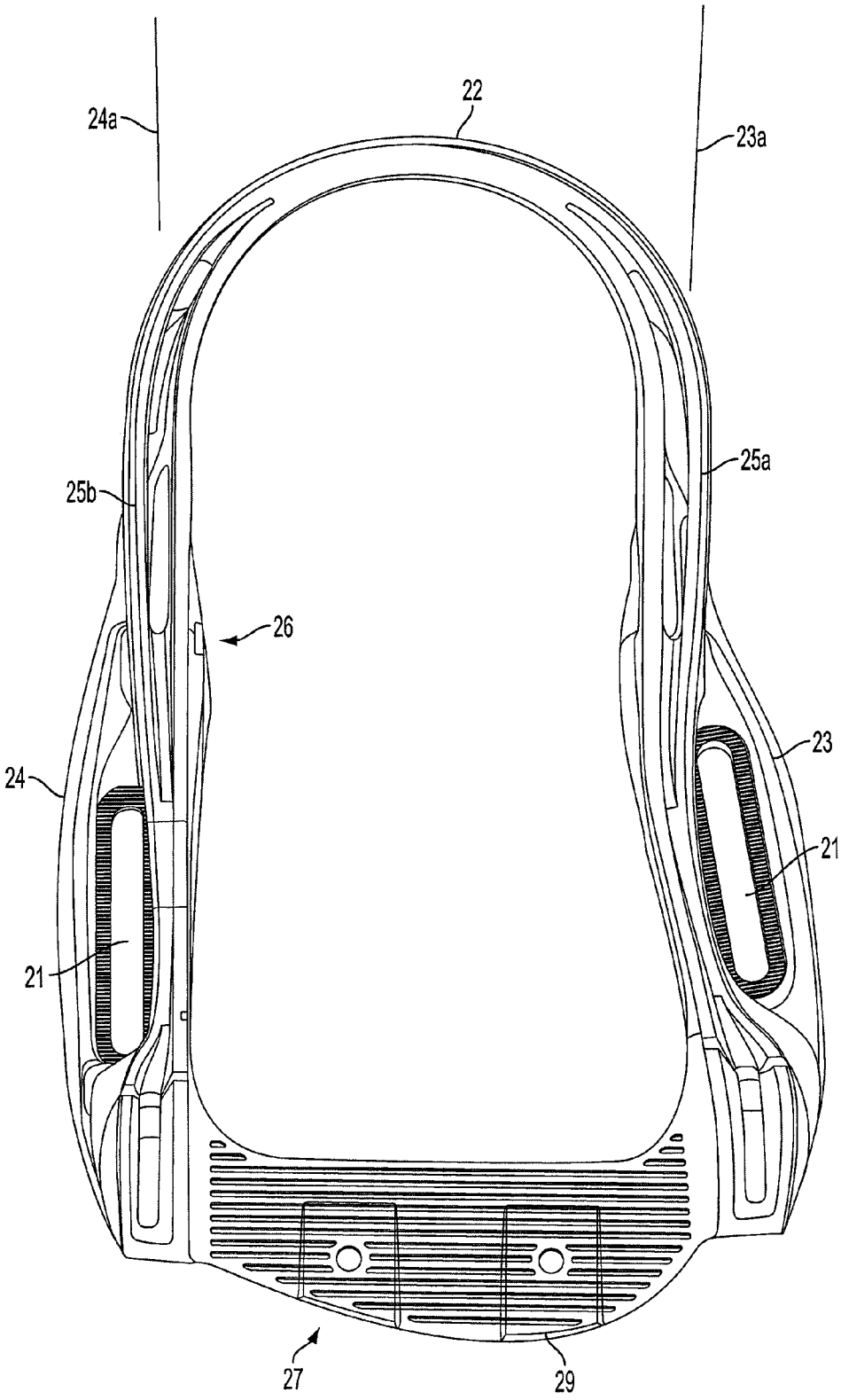
FIG. 5 shows a top view of the binding of FIG. 3.
Figure 6:
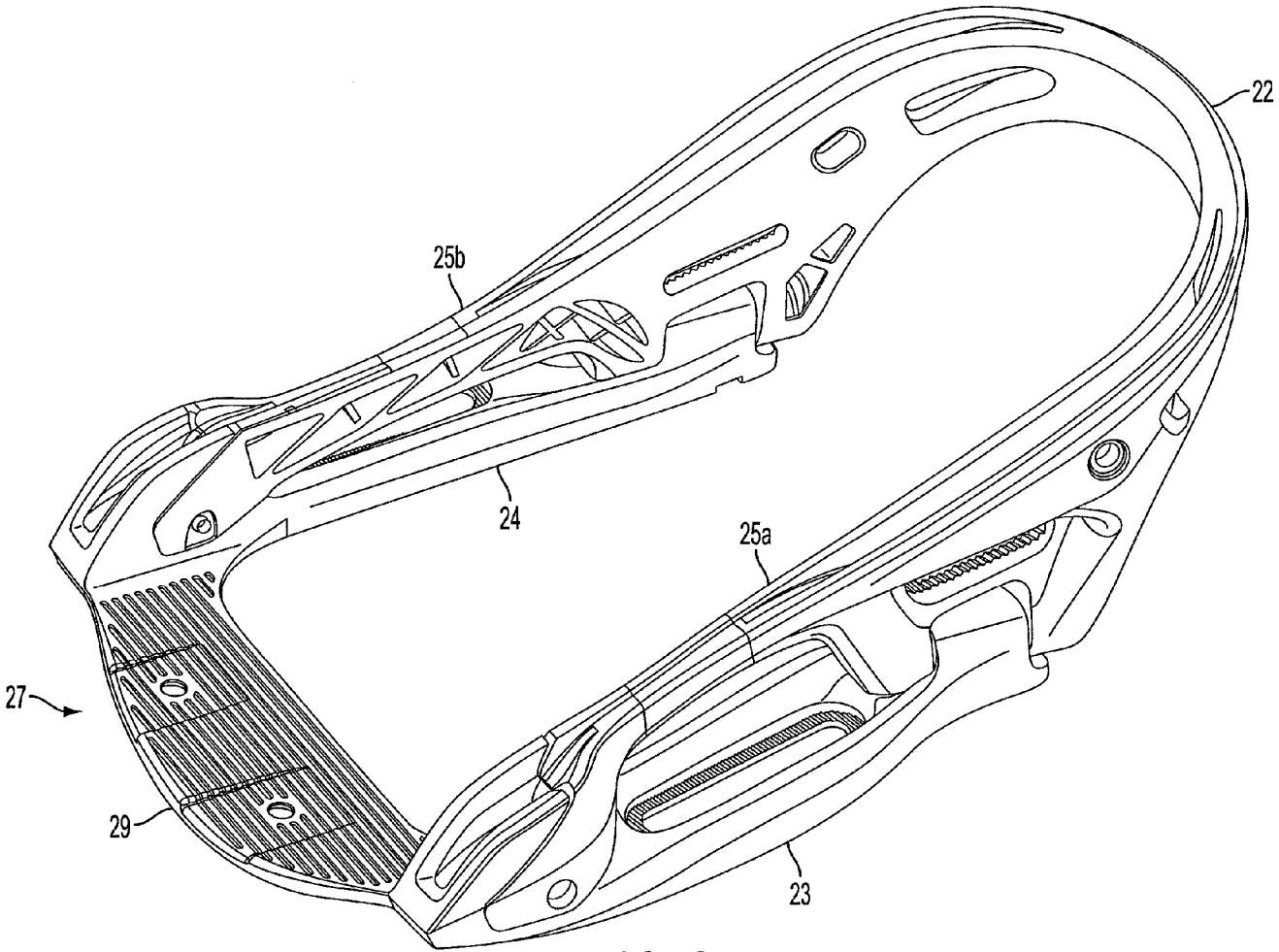
FIG. 6 shows a front, left perspective view of the binding of FIG. 3.

FIG. 5 shows a top view of the binding 1 of FIG. 3. This view illustrates that the medial and lateral portions 25 are not necessarily straight in their extension from the heel end 26 to the toe end 27 of the base 2. Instead, the medial and lateral portions 25 may have any suitable shape, such as a curved shape that generally follows the contour of the rider's boot. FIG. 5 also illustrates that the openings 21 in the base 2 for securing the binding 1 to a board may be offset from the medial and lateral portions 25, e.g., to ease the engagement of fasteners with the gliding board. Also, as shown in FIG. 6, a central part, or mid-region, of the medial and lateral portions 25 above the openings 21 may be spaced apart from the base 2, creating a space that may help ease the engagement of fasteners with the board at the openings 21. As can also be seen in FIG. 6 (particularly with respect to the lateral portion 25*b*), the medial and lateral portions 25 need not be solid elements, but rather may have a latticed, honeycombed or other "open" type structure that includes open spaces or voids through which connecting or reinforcing struts or other elements are provided. Such an arrangement may reduce the weight of the binding, as well as provide the ability to define flex zones or other structural characteristics of the medial and lateral portions 25. For example, the mid-region of the medial and lateral portions 25 may be carefully designed to provide the desired biasing, damping, restriction of movement, stiffness or other characteristics of the medial and lateral portions 25.

Figure 7:
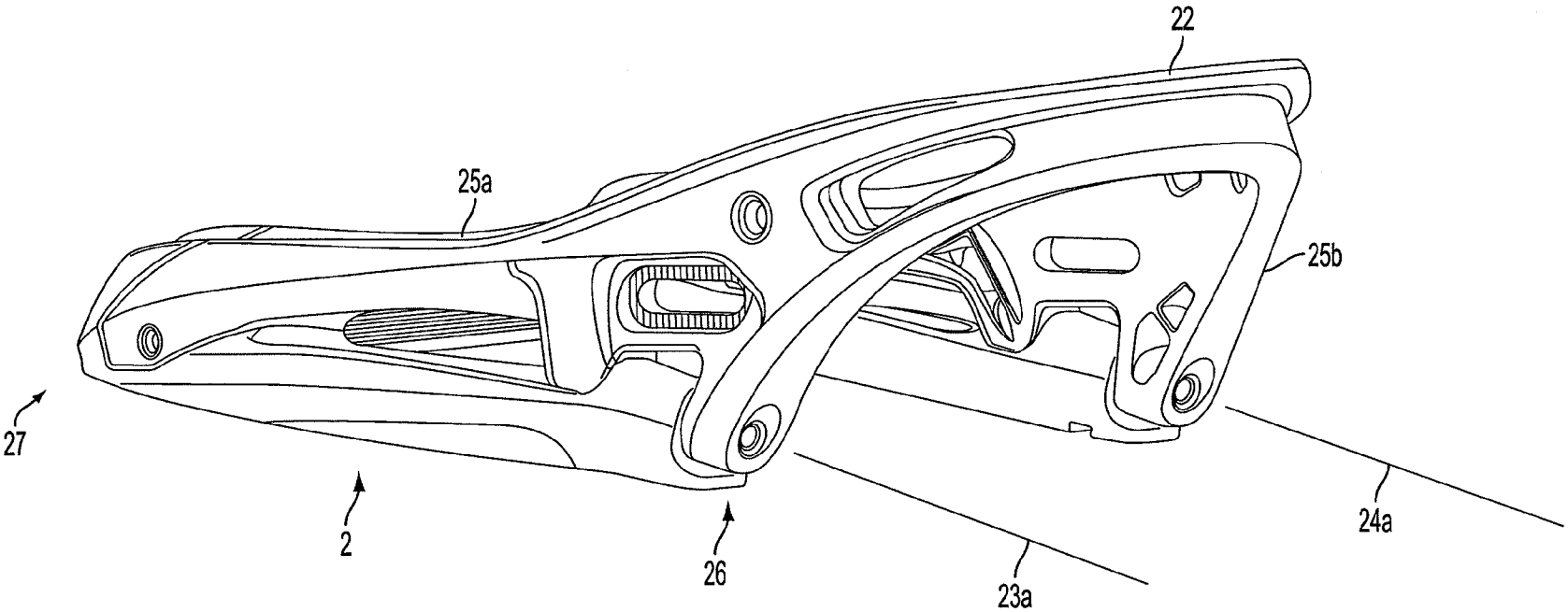
FIG. 7 shows a rear, left perspective view of the binding of FIG. 3.

FIG. 7 shows a rear perspective view of the binding of FIG. 3. This view helps to illustrate that the axes around which the medial and lateral portions 25 may move, i.e., in this case the medial and lateral axes 23*a*, 24*a*, need not necessarily be parallel to each other and/or to a heel-toe direction. For example, in this embodiment, the medial and lateral axes 23*a*, 24*a* are inclined upwardly to some extent, such that the axes 23*a*, 24*a* are lower, or closer to the binding's bottom surface 28 near the heel end 26 than at the toe end 27. In one embodiment, the axes 23*a*, 24*a* are arranged at an angle of about 5 degrees relative to a flat surface on which the bottom surface 28 of the binding 1 is placed. Of course, other angles are possible. Similarly, and as can be seen in FIG. 5, the axes 23*a*, 24*a* when viewed from a top of the binding 1 may parallel to the heel-toe direction, or may form any suitable angle with respect to a heel-toe direction, and need not be parallel to each other. Instead, the axes 23*a*, 24*a* may be arranged in any suitable way, e.g., in case it is desired to influence the medial and lateral portions 25 to move in different ways.

In another aspect of the invention, a method for using a binding includes providing a binding having a base constructed and arranged to be secured to a gliding board and to secure a rider's foot to the gliding board. In the case of a snowboard binding, the base may be arranged like that in a tray-type binding having a rigid bottom plate that is positioned between the rider's foot and the gliding board, may be arranged like that in a "baseless" binding in which the rider's foot may directly contact the gliding board's top surface, or may be arranged like a step-in binding, which may take a variety of different forms. The base may include medial and lateral side portions, a heel end, a toe end, a heel-toe direction that extends from the heel end to the toe end, and a bottom surface arranged to contact a top surface of a gliding board. The binding may also include at least one foot engagement member secured to the base and constructed and arranged to secure the rider's foot relative to the base. In some embodiments, the medial and/or lateral side portions may be part of a heel hoop and be connected together by a heel portion that extends across a heel end of the base. The medial and/or lateral side portions may extend in a heel-toe direction along the base and may be fixed at a toe end to the base.

The method may further include moving at least a part of the medial side portion relative to the base about a medial axis that is generally along the heel-toe direction, and/or moving at least a part of the lateral side portion relative to the base about a lateral axis that is generally along the heel-toe direction. For example, the medial and/or lateral side portions may be adjacent to the sides of a rider's foot such that as the rider moves his foot laterally or medially, the medial and/or lateral side portions are pivoted about respective axes relative to the base. The pivoting movement may occur about a pivot pin or other defined element. The medial and/or lateral side portions may pivot up to 60-90 degrees or more in total, e.g., 30-45 degrees medially from an upright position, and 30-45 degrees laterally from the upright position. The medial and/or lateral portions may not move in a heel-toe direction or in an up/down direction toward or away from the bottom surface of the binding. In some embodiments, the method may include limiting the movement of the medial and/or lateral side portions, e.g., preventing the side portions from pivoting more than a specified amount (or at all) from an upright position. In other embodiments, the method may include damping the movement of the medial and/or lateral side portions. In short, methods in accordance with the invention may include use and arrangement of the binding in accordance with the embodiments described above.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A foot binding for use with a gliding board, comprising:

a base constructed and arranged to be secured to a gliding board to secure a rider's foot to the gliding board, the base including medial and lateral sides, a heel end, a toe end, a heel-toe direction that extends from the heel end to the toe end, and a bottom surface arranged to contact a top surface of a gliding board;

a medial portion attached to the medial side, the medial portion extending along at least a portion of the medial side of the base in the heel-toe direction;

a lateral portion attached to the lateral side, the lateral portion extending along at least a portion of the lateral side of the base in the heel-toe direction; and at least one foot engagement member secured to the base and constructed and arranged to secure the rider's foot relative to the base;

wherein the medial portion is pivotally attached to the medial side of the base at a heel end of the medial portion so as to be movable relative to the medial side about a medial axis that is generally along the heel-toe direction and is fixedly attached to the base at a toe end of the medial portion, or the lateral portion is pivotally attached to the lateral side of the base at a heel end of the lateral portion so as to be movable relative to the lateral side about a lateral axis that is generally along the heel-toe direction and is fixedly attached to the base at a toe end of the lateral portion, the medial and lateral portions being fixed relative to the base in the heel-toe direction and in a direction away from the bottom surface of the base.

2. The binding of claim 1, wherein the medial and lateral portions are part of a heel hoop, and the medial and lateral portions are connected together by a heel portion that extends across the heel end of the base.

3. The binding of claim 2, wherein the medial and lateral portions are pivotally attached to the base at the heel end of the medial and lateral sides, respectively, and are fixedly attached to the base at the toe end of the medial and lateral sides, respectively.

4. The binding of claim 3, further comprising a medial pivot pin that attaches the medial portion to the heel end of the medial side, and a lateral pivot pin that attaches the lateral portion to the heel end of the lateral side.

5. The binding of claim 3, wherein the medial and lateral portions are flexible in a mid-region between the heel end and the toe end of the base.

6. The binding of claim 2, wherein the heel portion includes a hinge.

7. The binding of claim 1, wherein the medial and lateral sides respectively include a medial and lateral sidewall.

8. The binding of claim 1, wherein the medial and lateral sides each include a mounting hole arranged to receive a fastener to secure the base to a gliding board.

9. The binding of claim 8, wherein the mounting hole is arranged as a slot that extends generally in the heel-toe direction.

10. The binding of claim 1, wherein the base includes an opening between the medial and lateral sides arranged to allow a rider's foot to directly contact a gliding board when the rider's foot is secured to the gliding board by the binding.

11. The binding of claim 10, further comprising a cross bar that extends between the medial and lateral sides at the toe end of the base.

12. The binding of claim 11, further comprising a footbed that is positionable in the opening to contact a bottom of a rider's foot when the rider's foot is secured to a gliding board by the binding, wherein the footbed is secured to the cross bar.

13. The binding of claim 10, further comprising a footbed that is positionable in the opening to contact a bottom of a rider's foot when the rider's foot is secured to a gliding board by the binding.

14. The binding of claim 1, wherein the at least one foot engagement member includes a foot strap having a medial section attached to the medial portion and a lateral section attached to the lateral portion, the medial and lateral sections of the foot strap being arranged to extend over a rider's foot positioned between the medial and lateral portions and engage with each other to secure the rider's foot to the binding.

15. The binding of claim 1, wherein the at least one foot engagement member includes a foot strap attached to the medial and lateral portions and arranged to secure a rider's foot to the binding.

16. The binding of claim 1, wherein the medial and lateral portions are attached to the base at the heel end of the medial and lateral sides, respectively, and are attached to the base at the toe end of the medial and lateral sides, respectively, and wherein the medial and lateral portions are spaced apart from the medial and lateral sides of the base, respectively, in a mid-region between the heel end and toe end of the base.

17. The binding of claim 16, wherein the medial and lateral portions are pivotally attached to the base at the heel end of the medial and lateral sides, respectively, and are fixedly attached to the base at the toe end of the medial and lateral sides, respectively.

18. The binding of claim 17, wherein the medial and lateral portions are flexible in the mid-region between the heel end and the toe end of the base.

19. The binding of claim 1, further comprising a highback secured to the base and constructed and arranged to support a rider's leg.

20. The binding of claim 19, wherein the highback is attached to the medial and lateral portions.

21. The binding of claim 20, wherein the medial and lateral portions are part of a heel hoop, and the medial and lateral portions are connected together by a heel portion that extends across the heel end of the base.

22. The binding of claim 1, wherein the at least one foot engagement member includes a binding strap having an engagement portion engageable with, and selectively separable from, a buckle portion.

23. The binding of claim 22, wherein the at least one foot engagement member includes:

a toe strap attached to the toe end of the base, the toe strap having an engagement portion engageable with, and selectively separable from, a buckle portion; and an ankle strap attached to the medial and lateral portions near the heel end of the base, the ankle strap having an engagement portion engageable with, and selectively separable from, a buckle portion.

24. The binding of claim 1, wherein the medial and lateral portions extend from the heel end to the toe end of the base.

25. A foot binding for use with a gliding board, comprising:

a base constructed and arranged to be secured to a gliding board to secure a rider's foot to the gliding board, the base including medial and lateral sides, a heel end, a toe end, a heel-toe direction that extends from the heel end to the toe end, and a bottom surface arranged to contact a top surface of a gliding board;

a heel hoop having medial and lateral portions and a heel portion that extends across the heel end of the base and connects the medial and lateral portions together, the medial and lateral portions of the heel hoop being attached to the medial and lateral sides of the base, respectively, the medial and lateral portions being pivotally attached to the base at the heel end of the medial and lateral sides, respectively, and being fixedly attached to the base at the toe end of the medial and lateral sides, respectively, such that at least a part of the medial portion is pivotable relative to the medial side about a medial axis that is generally along the heel-toe direction, and at least a part of the lateral portion is pivotable relative to the lateral side about a lateral axis that is generally along the heel-toe direction; and at least one foot engagement member secured to the base and constructed and arranged to secure the rider's foot relative to the base.

26. The binding of claim 25, further comprising a highback secured to the base and constructed and arranged to support a rider's leg.

27. The binding of claim 26, wherein the highback is attached to the medial and lateral portions.

28. The binding of claim 25, further comprising a medial pivot pin that attaches the medial portion to the heel end of the medial side, and a lateral pivot pin that attaches the lateral portion to the heel end of the lateral side.

29. The binding of claim 25, wherein the medial and lateral portions are flexible in a mid-region between the heel end and the toe end of the base.

30. The binding of claim 25, wherein the heel portion includes a hinge.

31. The binding of claim 25, wherein the medial and lateral sides respectively include a medial and lateral sidewall.

32. The binding of claim 25, wherein the medial and lateral sides each include a mounting hole arranged to receive a fastener to secure the base to a gliding board.

33. The binding of claim 32, wherein the mounting hole is arranged as a slot that extends generally in the heel-toe direction.

34. The binding of claim 25, wherein the base includes an opening between the medial and lateral sides arranged to allow a rider's foot to directly contact a gliding board when the rider's foot is secured to the gliding board by the binding.

35. The binding of claim 34, further comprising a cross bar that extends between the medial and lateral sides at the toe end of the base.

36. The binding of claim 35, further comprising a footbed that is positionable in the opening to contact a bottom of a rider's foot when the rider's foot is secured to a gliding board by the binding, wherein the footbed is secured to the cross bar.

37. The binding of claim 34, further comprising a footbed that is positionable in the opening to contact a bottom of a rider's foot when the rider's foot is secured to a gliding board by the binding.

38. The binding of claim 25, wherein the at least one foot engagement member includes a foot strap having a medial section attached to the medial portion and a lateral section attached to the lateral portion, the medial and lateral sections of the foot strap being arranged to extend over a rider's foot positioned between the medial and lateral portions and engage with each other to secure the rider's foot to the binding.

39. The binding of claim 25, wherein the at least one foot engagement member includes a foot strap attached to the heel hoop and arranged to secure a rider's foot to the binding.

40. A foot binding for use with a gliding board, comprising:

a base constructed and arranged to be secured to a gliding board to secure a rider's foot to the gliding board, the base including medial and lateral sides, a heel end, a toe end, a heel-toe direction that extends from the heel end to the toe end, and a bottom surface arranged to contact a top surface of a gliding board;

a medial portion attached to the medial side of the base, at least a part of the medial portion being pivotable relative to the medial side about a medial axis that is generally along the heel-toe direction;

a lateral portion attached to the lateral side of the base, at least a part of the lateral portion being pivotable relative to the lateral side about a lateral axis that is generally along the heel-toe direction;

a highback secured to the base and constructed and arranged to support a rider's leg, the highback having an upper portion arranged to contact the rider's leg, and a lower portion that is attached to the medial and lateral portions such that the lower portion is pivotable relative to the medial or lateral sides about the medial axis or the lateral axis, respectively; and at least one foot engagement member secured to the base and constructed and arranged to secure the rider's foot relative to the base.

41. The binding of claim 40, wherein the medial and lateral portions are part of a heel hoop, and the medial and lateral portions are connected together by a heel portion that extends across the heel end of the base.

42. The binding of claim 41, wherein the medial and lateral portions are pivotally attached to the base at the heel end of the medial and lateral sides, respectively, and are fixedly attached to the base at the toe end of the medial and lateral sides, respectively.

43. The binding of claim 42, further comprising a medial pivot pin that attaches the medial portion to the heel end of the medial side, and a lateral pivot pin that attaches the lateral portion to the heel end of the lateral side.

44. The binding of claim 42, wherein the medial and lateral portions are flexible in a mid-region between the heel end and the toe end of the base.

45. The binding of claim 40, wherein the highback is pivotable relative to the base in the heel-toe direction.

46. The binding of claim 40, wherein the at least one foot engagement member includes a foot strap having a medial section attached to the medial portion and a lateral section attached to the lateral portion, the medial and lateral sections of the foot strap being arranged to extend over a rider's foot positioned between the medial and lateral portions and engage with each other to secure the rider's foot to the binding.

* * * * *